United States Patent [19]

Channing et al.

[11] Patent Number: 4,837,566

[45] Date of Patent: Jun. 6, 1989

[54] DRIVE CIRCUIT FOR OPERATING ELECTROLUMINESCENT DISPLAY WITH ENHANCED CONTRAST

[75] Inventors: Dean A. Channing, St. Charles; Lih W. Chiang, Waukegan, both of Ill.

[73] Assignee: The Cherry Corporation, Waukegan, Ill.

[21] Appl. No.: 148,107

[22] Filed: Jan. 27, 1988

Related U.S. Application Data

[63] Continuation of Ser. No. 755,200, Jul. 12, 1985, abandoned.

[51] Int. Cl.[4] ..... G09G 3/30

[52] U.S. Cl. ..... 340/781; 315/169.3

[58] Field of Search ..... 340/781, 784, 790, 800, 340/802, 803, 804, 731; 315/169.3

[56] References Cited

U.S. PATENT DOCUMENTS 4,123,751 10/1978 Gladstone et al. ..... 340/781

4,338,598 7/1982 Ohba et al. ..... 340/781 X 4,479,120 10/1984 Ohba et al. ..... 340/781

4,485,379 11/1984 Kinoshita et al. ..... 340/781

4,554,539 11/1985 Graves ..... 340/781 X 4,594,589 6/1986 Ohba et al. ..... 340/781 X

*Primary Examiner*—Gerald L. Brigance

*Assistant Examiner*—Mochoud Fatahi Yar

*Attorney, Agent, or Firm*—Willian Brinks Olds Hofer Gilson & Lione Ltd.

[57] ABSTRACT

An improved drive circuit for operating an electroluminescent display includes a circuit for biasing column and row drivers to maximize the energization voltage for illuminated pixels without reducing the contrast of the display. Interface circuitry is also provided for detecting the beginning of valid data for each line to be displayed, checking the selected display mode of the line and adjusting the timing of a system clock to completely and uniformly display characters in the 40-column, 80-column or graphics display mode.

18 Claims, 4 Drawing Sheets

DRIVE CIRCUIT FOR OPERATING ELECTROLUMINESCENT DISPLAY WITH ENHANCED CONTRAST

This application is a continuation of application Ser. No. 755,200, filed July 12, 1985, now abandoned.

TECHNICAL FIELD

The invention relates to a driver circuit for energizing a direct current electroluminescent (EL) display panel to display images of characters. More particularly, the invention relates to a drive circuit which provides enhanced contrast for the displayed characters and properly aligns the characters in 80 column, 40 column and graphics display modes.

BACKGROUND OF THE INVENTION

The Cathode Ray Tube (CRT) has long been used as a video display, for example, in television sets and in computer display terminals. CRTs utilize an electron gun to selectively scan and energize a phosphor screen. The energized portions of the screen momentarily luminesce to provide a visual image. CRTs have a substantial depth, in order to accommodate the relatively large apparatus of the electron gun.

Electroluminescent display panels have been developed to provide a relatively thin display which does not have the size constraints inherent in the apparatus of a CRT. Electroluminescent display panels employ a matrix of phosphor pixels which are selectively fluoresced to form an image. The phosphor pixels of an electroluminescent display are caused to fluoresce by the direct application of electrical energy.

The electroluminescent display has a plurality of anodes and cathodes which are arranged in overlapping relation to form columns and rows of a matrix of pixel elements. An electroluminescent phosphor is disposed adjacent to each crossover point of the electrodes of the matrix. When a line and column electrode are simultaneously energized, the phosphor pixel element at the crossover point of the electrodes is caused to luminesce. An image is formed on the display by sequentially energizing rows of electrodes of the matrix and selectively energizing corresponding column electrodes.

The brightness of the display is dependent upon the voltage difference between energized row and column electrodes. Thus, increasing the voltage difference between row and column electrodes has the desirable effect of increasing the brightness of energized pixels. However, when row and column voltages are increased to provide added brightness, contrast of the image is sharply reduced when either a row or column energization voltage exceeds a characteristic "forming voltage" for the display. A desirable increase in brightness for the display has therefore not been achievable in view of this sharp loss of contrast with increasing voltage.

Accordingly, it is an object of the invention to provide a direct current electroluminescent display panel and associated driver circuitry which provide a substantially brighter image, without a corresponding sharp loss in image contrast.

A further object of the invention is to provide drive circuitry which defines an increased voltage difference for maximizing the brightness of energized pixels and defines a reduced voltage below the forming voltage for de-energized background pixels.

Electroluminescent display panels are most efficiently and economically constructed with a sharply defined area for displaying the video information. It is desirable to display such information in standard 40-column, 80-column or graphic display formats. If different display formats are mixed on a screen of data, the sharply defined display area of the electroluminescent panel may cause the display characters at the ends of lines to disappear from the screen. This problem is particularly likely to occur if the EL display panel is receiving data from a device, for example a computer, which operates with CRTs that have a less sharply defined display field. Under said circumstances, an end character of a line can be lost if the display is switched from either a 40-column or graphic display mode to an 80-column display mode within one screen of data.

Accordingly, it is an object of the invention to provide an interface circuit for an electroluminescent panel which synchronizes a clock generator to incoming data signals in order to provide a complete, left justified display of information when display modes are changed in one screen of data.

A further object of the invention is to provide such an interface circuit which checks the data mode for each line of the display and adjusts the timing of the interface circuitry to ensure that all data is displayed within the sharply defined display field of the screen.

These and other objects of the invention will become apparent from a review of the specification which follows and of the drawings which are described hereafter.

SUMMARY OF THE INVENTION

In order to achieve the objects of the invention and to overcome the problems of the prior art, the drive circuit for the direct current electroluminescent display includes row and column drivers arranged in a matrix with an electroluminescent phosphor disposed at crossover points of the matrix. The energization voltages for the drivers of the rows and columns are selected to maximize the crossover voltage between an energized row driver and column driver and to thereby increase the brightness of the luminescent phosphor at the crossover point. The energization voltages for the row and column drivers are combined with selected reverse biased de-energization voltages for inactivated pixels so that the differential voltage at such pixels is less than the forming voltage for the EL panel.

The EL display apparatus of the invention includes an interface circuit which detects the beginning of a display portion of each incoming row of character data, synchronizes an internal display clock to this valid data point and adjusts the phase of the clock to synchronize with the 80-column, 40-column or graphic display format of the data in the row. The circuit determines the selected display format for the row by detecting the frequency of signals generated for each character of information passed to the display. The circuit shifts the phase of the internal clock by 90 ° if an 80-column format is detected.

The detection of the display format for each line and the adjustment of the internal clock ensures that all data will be displayed, even if the display format is switched from a 40-column or graphics presentation to an 80-column presentation within a frame or screen of data.

DETAILED DESCRIPTION OF PREFERRED EMBODIMENTS

Figure 1:
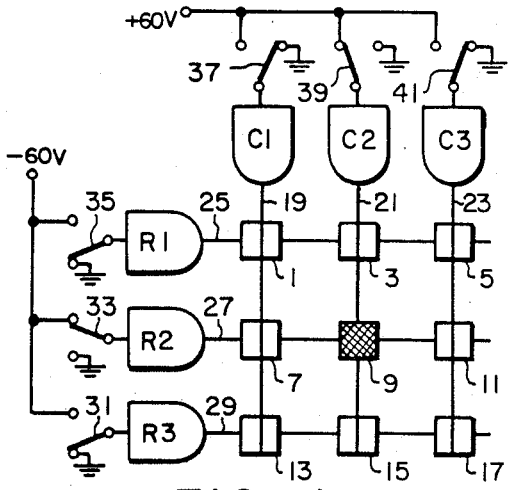
FIG. 1 is a diagrammatic illustration of a portion of an EL panel and of the energization voltages which are employed to light a pixel of the panel in a known manner.

The remaining portion of the specification will describe preferred embodiments of the invention when read in conjunction with the attached drawings, in which like reference characters identify identical apparatus.

The apparatus of the invention will hereafter be described with respect to a direct current electroluminescent (EL) display panel in which phosphor dots of a matrix display are selectively fluoresced to form character images. Such display panels may be produced in accordance with the disclosures of the following patents which are incorporated herein by reference.

| Patent No. | Issue Date | Inventor | Title |
|---|---|---|---|
| 3,731,353 | May 8, 1973 | Vecht | Method of Making Electroluminescent Devices |
| 4,140,937 | Feb. 20, 1979 | Vecht et al. | Direct Circuit Electroluminescent Devices |

A preferred process for manufacturing an EL display panel which may be used with the apparatus of the invention is particularly disclosed in a patent application Ser. No. 752,317 of David Glaser, filed July 3, 19S5, entitled Phosphorescent Material For Electroluminescent Display, and assigned to the assignee of this invention. The disclosure of this application is incorporated herein by reference, with the understanding that the disclosure is incorporated for the purpose of indicating the background of the present invention.

FIG. 1 is a diagrammatic illustration of a portion of a direct current EL display panel and of apparatus for energizing the panel to form character images. As shown in FIG. 1, the panel is comprised of phosphor pixel elements 1–17, which are arranged in a matrix at crossover points of conducting row electrodes 25, 27, 29 and column electrodes 19, 21 and 23. Elements 1, 3 and 5 are arranged to form a top row, elements 7, 9 and 11 form a middle row and elements 13, 15 and 17 form an end row. The elements 1, 7 and 13 form a first column, elements 3, 9 and 15 form a second column and elements 5, 11 and 17 form a third column.

The row electrodes 25–29 are respectively connected to the outputs of associated row drivers R1, R2 and R3. Likewise, the column electrodes 19-23 are respectively connected to the outputs of associated column drivers C1, C2 and C3.

In order to facilitate an understanding of the invention, the row and column drivers are shown with associated switches 31–41 which are selectively operated to apply activating signals to the drivers. It should be understood that in actual practice digital circuits are employed to power and operate the drivers to energize the associated column and row electrodes. The switches are used in FIG. 1 to broadly illustrate the operation of an EL panel, without introducing confusing complexity.

The operation of the panel of FIG. 1 will now be discussed, with the assumption that it is only desired to illuminate the central pixel element g of the matrix. In operation, selected pixels of the panel of FIG. 1 are energized by sequentially scanning rows of the panel with columnar data provided by the drivers C1–C3. Data for the top row 25 of pixels 1, 3 and 5 is initially provided at the inputs of the drivers C1, C2 and C3. In this example, the switches 37, 39 and 41 are connected to ground to indicate that none of the pixels 1, 3 and 5 of the first row are activated. When the inputs of Cl, C2 and C3 are grounded, the input switches 31 and 33 are grounded and switch 35 of the row driver Rl is closed to apply an activating voltage, for example −60 volts to the row electrode 25. Energization of the row driver Rl results in a 60 volt signal being applied to each of the pixels 1, 3 and 5. It will hereafter be assumed that the panel of FIG. 1 was "formed" with a voltage of approximately 70 volts and that therefore, as is known in the art, pixels will luminesce only at voltages approaching or exceeding 70 volts. For purposes of discussion, it will hereafter be assumed that significant luminescence begins at about 70 volts, while little or no luminescence occurs at about 60 volts. These assumptions have proven reasonable for test EL panels formed at 70 volts. Accordingly, the 60-volt signals applied by the driver Rl do not cause the pixels 1, 3 and 5 to luminesce.

The input switch 35 is then switched to ground to complete scanning of row 25 and the switches 37, 39 and 41 are moved to define the columnar data for electrode 27. As indicated previously, it is desired to illuminate the pixel g. Accordingly, as illustrated in FIG. 1, the input of driver Cl is connected to ground, the input of driver C2 is connected to an activating voltage, for example 60 volts, and the input of driver C3 is connected to ground. When the switch 33 at the input of the row driver R2 is connected to −60 volts to scan row 27 120 volts is applied at pixel 9 and 60 volts is applied at pixels 7 and 11. The 120-volt signal at pixel 9 is greater than 70 volts and the pixel is therefore caused to luminesce.

The input of row driver R2 is thereafter grounded to discontinue scanning of row 27. When the row electrode 27 is de-energized, the pixel 9 continues to luminesce for a predetermined time and therefore provides a persistent image to the eye. Following deenergization of the row driver R2, the inputs to the column drivers Cl, C2 and C3 are all connected to ground to reflect the data for the last row 29. Thereafter, the switch 31 is activated to apply −60 volts to the electrode 29 from the row driver R3. The resulting 60-volt signals at the pixels 13, 15 and 17 are insufficient to light the pixels.

The scanning cycle for the rows and columns is repeated as often as is desired to maintain a continuous fluorescence of the pixel 9. Alternatively, new columnar data may be defined to illuminate other pixels when the row electrodes 25, 27 and 29 are sequentially energized.

Figure 2A:
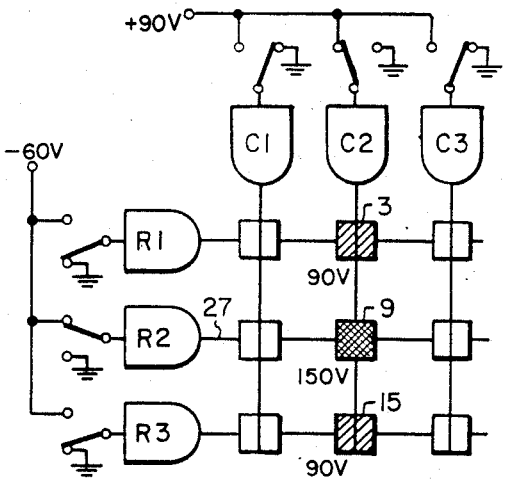
FIG. 2A is a diagrammatic illustration of the panel of FIG. 1 energized to provide increased brightness for a selected pixel, but having reduced contrast with respect to a vertical line passing through the pixel.

It is known that the brightness of luminescence of a phosphor pixel may be increased by increasing the energization voltage applied to the pixel. FIG. 2A illustrates the EL panel of FIG. 1, with an increased voltage of 90 volts applied as a positive energization reference for the column drivers Cl, C2 and C3. The panel of FIG. 2A is scanned in the manner described with respect to FIG. 1 to energize the central phosphor pixel 9. In order to facilitate an understanding of the invention, the switches which operate the row and column drivers are shown connected in position to scan row 27. As illustrated, when the row driver R2 is activated with −60 volts, and the column driver C2 is activated with +90 volts, a differential voltage of 150 volts is provided at the pixel 9. Accordingly, the brightness of the pixel 9 is increased with respect to the brightness illustrated with respect to FIG. 1. However, as illustrated in FIG. 2A, the 90 volt column voltage is also applied to the pixels 3 and 15 which lie in the row of the illuminated pixel 9. These 90 volt signals exceed the 70 volt forming voltage and therefore cause the pixels 3 and 15 to fluoresce.

Figure 2B:
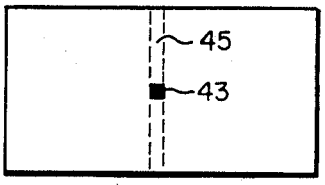
FIG. 2B is an illustration of the reduced contrast display which would result from the energized panel of FIG. 2A.

FIG. 2B is a diagrammatic illustration of a larger EL panel in which a central pixel has been energized in the manner disclosed for FIG. 2A. Thus, as shown in FIG. 2B, the central pixel 43 is illuminated. However, a distracting "ghost line" 45 is formed in the vertical column of the central pixel 43 by the associated pixels which luminesce in response to the 90-volt signals illustrated in FIG. 2A. The line 45 thus reduces the contrast of the pixel 43 and provides an undesirable artifact on the screen. If the voltage for the drivers C1--C3 is further increased, the luminescence of the central pixel 43 and the line 45 will increase. The energization scheme of FIG. 2A is therefore ineffective to provide increased brightness and high contrast for the energized pixel.

Figure 3A:
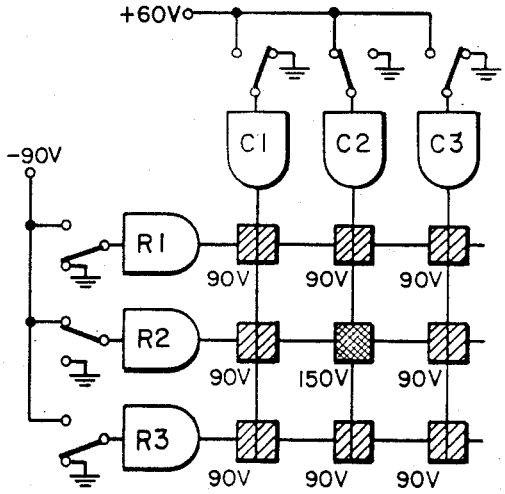
FIG. 3A is a diagrammatic illustration of the panel of FIG. 1 energized to provide increased brightness for a selected pixel, but having reduced contrast between the pixel and the entire EL panel.
Figure 3B:
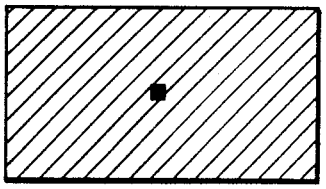
FIG. 3B illustrates the reduced contrast display which would result from the energized panel of FIG. 3A.

FIG. 3A illustrates an alternative undesirable energization mode. In this mode the energization voltage for the row drivers R1–R3 is a −90 volts and the energization voltage for the column drivers C1–C3 is returned to +60 volts. When the panel of FIG. 3 is scanned in the above-described fashion, the central pixel 9 again has a brightness which corresponds to an applied voltage of 150 volts. However, under these conditions, the remaining pixels all have 90 volts supplied from the scanning row drivers R1–R3 and therefore luminesce in the manner described with respect to the ghost line 45. The energization of all of the background pixels of FIG. 3A substantially reduces the contrast of the central pixel 43, as illustrated for the display of FIG. 3B.

Figure 4:
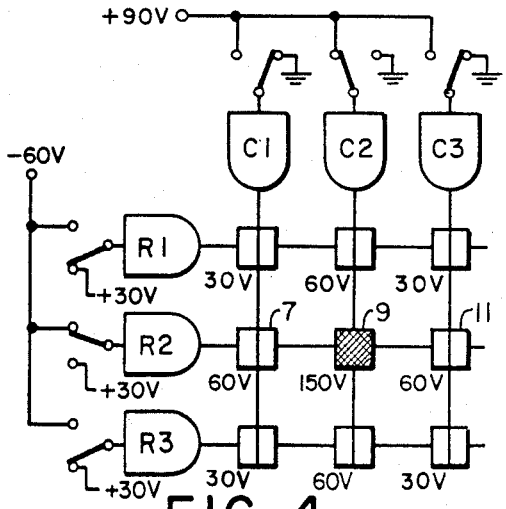
FIG. 4 is a diagrammatic illustration of a portion of an EL panel which is energized in accordance with the invention to provide increased brightness and contrast for an energized pixel.

FIG. 4 illustrates a mode of energization in accordance with the invention which allows the central pixel 9, or any other desired pixels, to be energized at 150 volts, without forming a vertical ghost line. As shown in FIG. 4, the row drivers R1–R3 are not returned to ground after being activated at −60 volts for a scanned row. Instead, inactivated row lines are biased to a positive voltage of, for example, 30 volts. The biased voltage is selected so that 90 volts may be applied by the column drivers C1–C3 without energizing any pixel but the desired pixel 9. Thus, in operation, when the first row 25 is scanned by Rl, the column drivers C1–C3 are grounded and 60 volts is applied to the first row of pixels. When the second row 27 is energized, 60 volts is applied to the pixels 7 and 11 with grounded column drivers Cl and C3 and 150 volts is applied to the pixel g with the column driver C2 operated at 90 volts. Likewise, when the row driver R3 is activated, the pixels of the row are energized with 30 or 60 volts and therefore do not luminesce.

It should be appreciated that the desirable high brightness and high contrast of FIG. 4 is achieved by providing a bias voltage for the row drivers which maintains the voltage of deactivated or background pixels below the forming voltage (70 volts) of the panel. Thus, only activated pixels luminesce. The energization scheme of FIG. 4 thus eliminates the display problem illustrated in FIGS. 2A and 2B.

Figure 5:
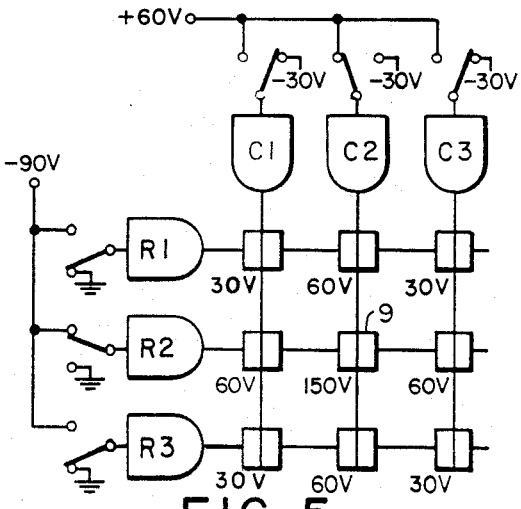
FIG. 5 illustrates an alternative embodiment of an energized EL panel with increased brightness and contrast in accordance with the invention.

FIG. 5 illustrates an alternative embodiment of the invention wherein the voltage of the row drivers R1–R3 is a 90 volts and a bias voltage of −30 volts is provided for the column drivers C1–C3. If the panel is scanned in the previously described manner, 150 volts will be applied to illuminate the central pixel 9 and only 60 or 30 volts will be applied to the remaining pixels of the display. The energization scheme of FIG. 5 thus eliminates the display problem illustrated at FIGS. 3A and 3B.

Figure 6:
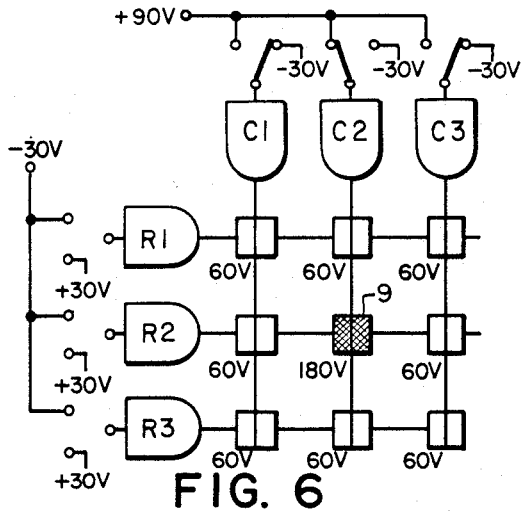
FIG. 6 illustrates yet another alternative embodiment of an energized EL panel with increased brightness and contrast in accordance with the invention.

FIG. 6 illustrates an alternative embodiment of the invention wherein bias voltages and increased activation voltages are provided for both the row and column drivers. As shown in FIG. 6, the central pixel 9 is energized with a voltage of 180 volts and will therefore have a brightness that is substantially greater than was provided for the EL panel of FIG. 1. It should be understood that the drivers are biased to ensure that the voltage of background pixels remains below the forming voltage of 70 volts.

It should generally be understood that the energization schemes of FIGS. 4, 5 and 6 may be applied to illuminate any desired number of pixels in any desired size of EL panel. Moreover, energization and bias voltages other than those disclosed may be employed in the manner described without departing from the invention.

Figure 7A:
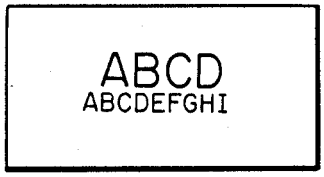
FIG. 7A illustrates a character offset which can occur for a CRT display when the display mode is switched from either the 40 column or graphic display modes to the 80 column display mode.

It should now be understood that substantially increased brightness may be achieved with no loss of contrast, by providing bias voltages and increased activation voltages for the drivers of an EL panel. The display of the EL panel may be further improved in accordance with the invention to avoid display problems illustrated at FIGS. 7A and 7B. FIG. 7A illustrates a CRT display which has two lines, the first line displayed in the 40-column or graphic display line format and the second line displayed in the 80-column display line format. As known by those skilled in the art, the 80-column format provides two characters of 7 pixels each for every 14-pixel character of the 40-column or graphic display formats. As shown in FIG. 7A, if the mode of display is switched from 40 columns or graphics to 80 columns on a CRT screen, it is possible that the 80-column line will be offset by one character with respect to the 40-column or graphics line. CRT displays have an "overscan" operation which causes the 80-column line to be offset by one character ("A") with respect to the 40-column or graphics line.

Figure 7B:
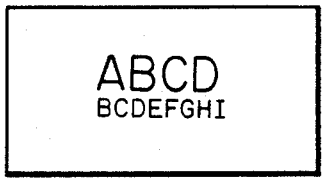
FIG. 7B illustrates the loss of a character which can occur when the offset characters of FIG. 7A are displayed on an EL panel.

FIG. 7B illustrates the lines of FIG. 7A as they will appear on an EL display. EL displays do not typically have the overscan capability of a CRT and therefore, the first character of the offset 80-column line will be lost. Obviously, this mode of display is undesirable and must therefore be corrected by improved synchronization and mode switching apparatus for the EL display. The invention therefore includes improved mode switching circuitry which ensures that modes such as 40-column, graphics and 80-column may be switched during a single frame or screen, without providing the offset or loss of data illustrated at FIGS. 7A and 7B.

Figure 8:
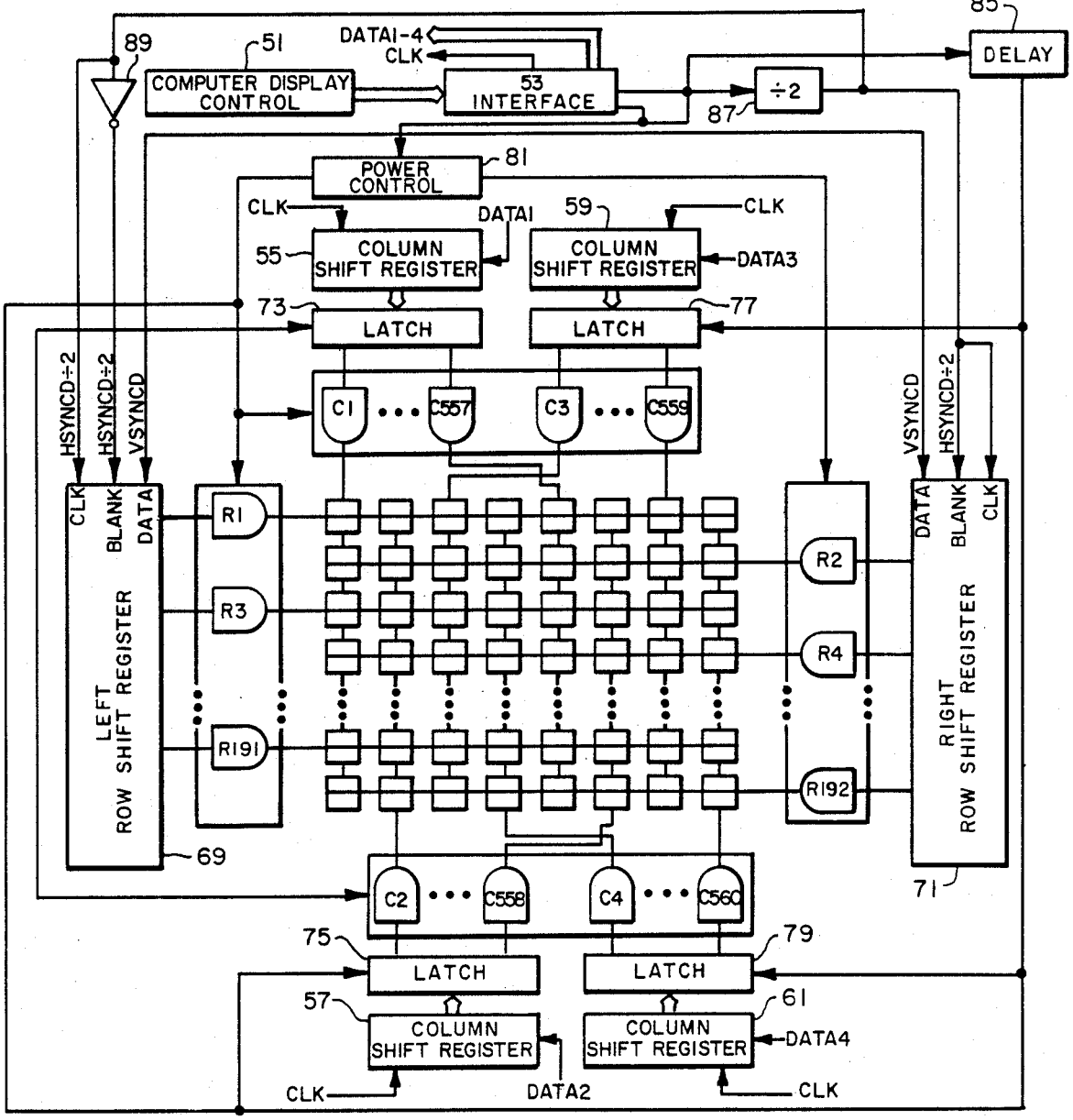
FIG. 8 is a block diagram of the drive circuit for operating an EL panel in accordance with the invention.

FIG. 8 is a block diagram of an embodiment of the improved EL driving system of the invention. The system of FIG. 8 provides a display with high brightness and contrast and further checks the display mode for each line of the display and synchronizes the clock of the display to ensure that data is not lost when display modes are changed within a frame or screen of data.

A preferred embodiment of the EL display panel of the invention has been implemented with an Apple IIc computer 51 as a display control. The system utilizes an interface circuit 53 which receives standard clock, data and timing signals of the Apple IIc computer, generates 4-phase data and clock signals and derives horizontal and vertical synchronization signals for operating the EL display. The interface thus converts Apple IIc signals which are suitable for operating a CRT to the signals required to operate an EL display.

In order to facilitate an understanding of the invention, only a few vertical and horizontal lines of the EL display matrix are illustrated in FIG. 8. It should generally be understood that a preferred embodiment of the invention utilizes 560 vertical column electrodes and 192 horizontal row electrodes. Also, each character displayed on the EL panel has a predefined pixel width. Thus, each character in the 40-column or graphic display modes is 14 pixels wide and in the 80-column mode each character is 7 pixels wide.

With reference to FIG. 8, the computer 51 passes 560 bits of serial data for each row of the display to the interface circuit 53. The interface 53 receives the serial data in groups of 4 bits and transmits each of the 4 bits to an associated column shift register. Thus, for example, bit 1 of the initial 4 bits of serial data is transmitted as DATA1 to a shift register 55, bit 2 is transmitted as DATA2 to a shift register 57, bit 3 is transmitted as DATA3 to a shift register 59 and bit 4 is transmitted as DATA4 to a shift register 61. When the next group of four serial bits is received from the computer, bit 5 is passed to register 55, bit 6 is passed to register 57, bit 7 is passed to register 59 and bit 8 is passed to register 61. The serial data is transmitted until each shift register has received 140 bits, for a total of 560 bits received.

Figure 9:
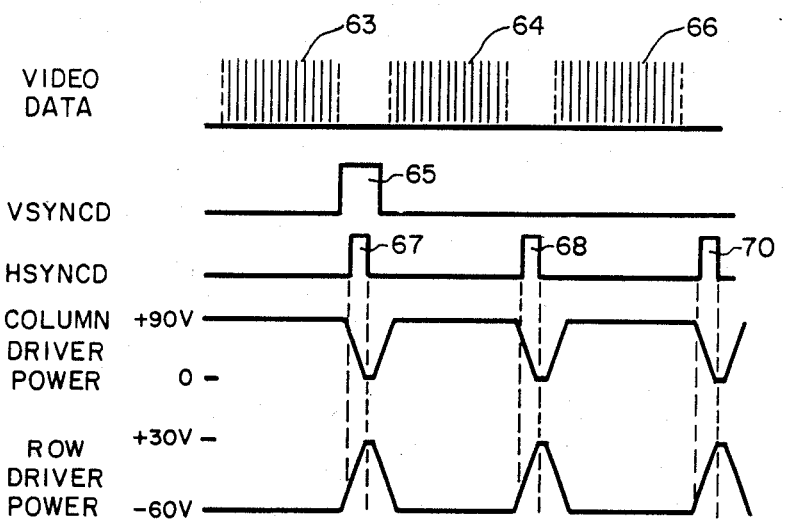
FIG. 9 is a timing diagram of operational signals for the drive circuit of FIG. 8.

With reference to the timing diagram of FIG. 9, when all 560 bits for the first horizontal row are received at 63, the interface 53 generates a derived vertical synchronization signal VSYNCD 65 and a derived horizontal synchronization signal HSYNCD 67 which initiate shifting of data into the shift registers of the display and control the application of power to the column and row drivers.

Before proceeding to a detailed discussion of the operation of the circuit of FIG. 8, it should be understood that all of the circuit is supported on a single substrate board. Accordingly, the components of the circuit have been arranged to provide for a balanced transmission of signals on the board. Thus, the four-phase column shift registers 55, 57, 59 and 61 are disposed at top and bottom positions on both sides of the board and the associated column electrodes are interleaved. Also, row shift registers 69 and 71 are disposed at opposite end positions on both sides of the board and their associated electrodes are interleaved.

With reference to the timing diagram of FIG. 9, when 560 data bits for the 560 pixels of the first horizontal line are received at 63, the derived horizontal sync signal HSYNCD 67 is applied to a power control circuit 81 which begins ramping positive and negative high voltage power respectively to the column drivers and row drivers. In a preferred embodiment of the invention, column drivers are manufactured by Texas Instruments and are generally designated SN75555, SN75556 and row drivers are generally designated SN75551 and SN75552. The power ramping rate for these drivers should not be greater than 50 volts per microsecond. Thus, with reference to FIG. 9, the leading edge of each HSYNCD signal will cause the positive high voltage (for example 90 volts) for the column drivers to begin to ramp down and the negative high voltage (for example −60 volts) of the row drivers to begin to ramp upwardly.

The leading edge of the HSYNCD signal is delayed by a delay circuit 85 and is applied to latch the data of the shift registers 55–61 into respective latches 73–79 when the power of the column drivers has been sufficiently reduced to avoid an undesirable current surge of the drivers in response to changing data. Thereafter, beginning on the trailing edge of the HSYNCD signal, the power for the column drivers is increased to its maximum positive voltage and the power for the row drivers is decreased to its maximum negative voltage.

It should generally be understood that the circuit of FIG. 8 operates in accordance with the improved energization scheme of FIG. 4. Thus, with reference to FIG. 9, row power is energized from −60 volts to +30 volts and column power is energized from 0 volts to +90 volts. As previously discussed with respect to FIG. 4, this energization scheme ensures that pixels will be energized with a total voltage of 150 volts, without forming a vertical ghost line. The embodiment of FIG. 4 has been successfully implemented with the particular designated Texas Instruments row and column drivers.

As shown in FIG. 9, after the first line of data is displayed, successive lines of data are sequentially received at 64 and 66 and successive HSYNCD pulses 68 and 70 cause the lines to be sequentially displayed. Although FIG. 9 illustrates a timing diagram of signals for only the first three lines of the matrix of FIG. 8, it should be understood that the same timing is repeated to sequentially energize the 192 rows of the matrix. Thereafter, energization of the EL panel is repeated from line 1.

The HSYNCD and VSYNCD pulses are also applied to the row shift registers 69 and 71 to scan the rows of the matrix. Thus, with reference to FIG. 9, when the first line of 560 pixels of data is received in the shift registers 55–61 at 63, the VSYNCD pulse 65 is applied as a data input to both of the shift registers 69 and 71. The HSYNCD pulse 67 and successive HSYNCD pulses are applied to a divider 87 which divides the frequency of the pulses by a factor of two. The output of the divider is applied to clock inputs of the left and right shift registers 69 and 71. Thus, the high data of the VSYNCD pulse 65 is simultaneously gated by the leading edge of the divided HSYNCD signal 67 into the left and right shift registers. The divided HSYNCD signal is also applied to a blanking lead of the right shift register 71 and the inverse of this signal (at the output of an inverter 89) is applied to a blanking input of the left shift register 69. As a result of the reverse polarity of the blanking signals, the left and right row drivers are alternately activated to sequentially scan the rows of the matrix. Successive divided HSYNCD pulses thereafter gate the initial data bit of the shift registers 69 and 71 through the shift registers to sequentially activate the row driver for each line.

Figure 11:
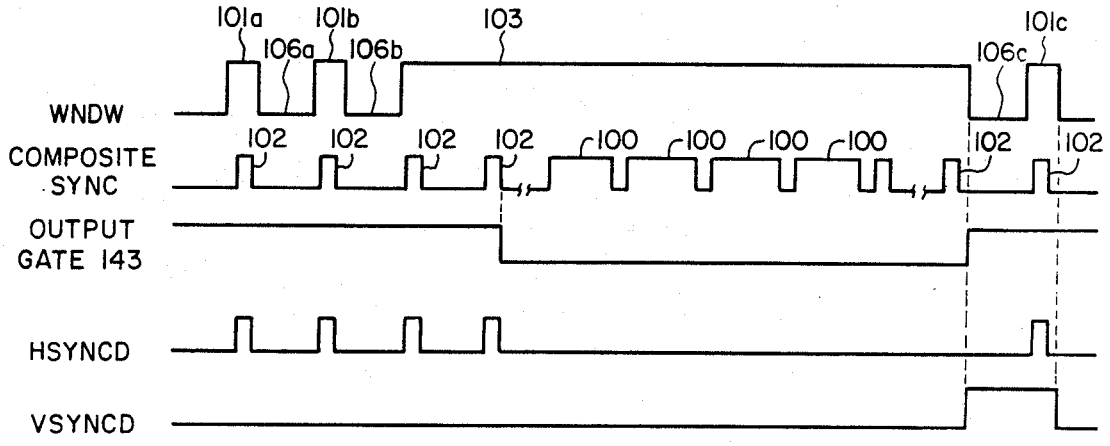
FIG. 11 is a timing diagram of operational signals for the logic circuit of FIG. 10.
Figure 10:
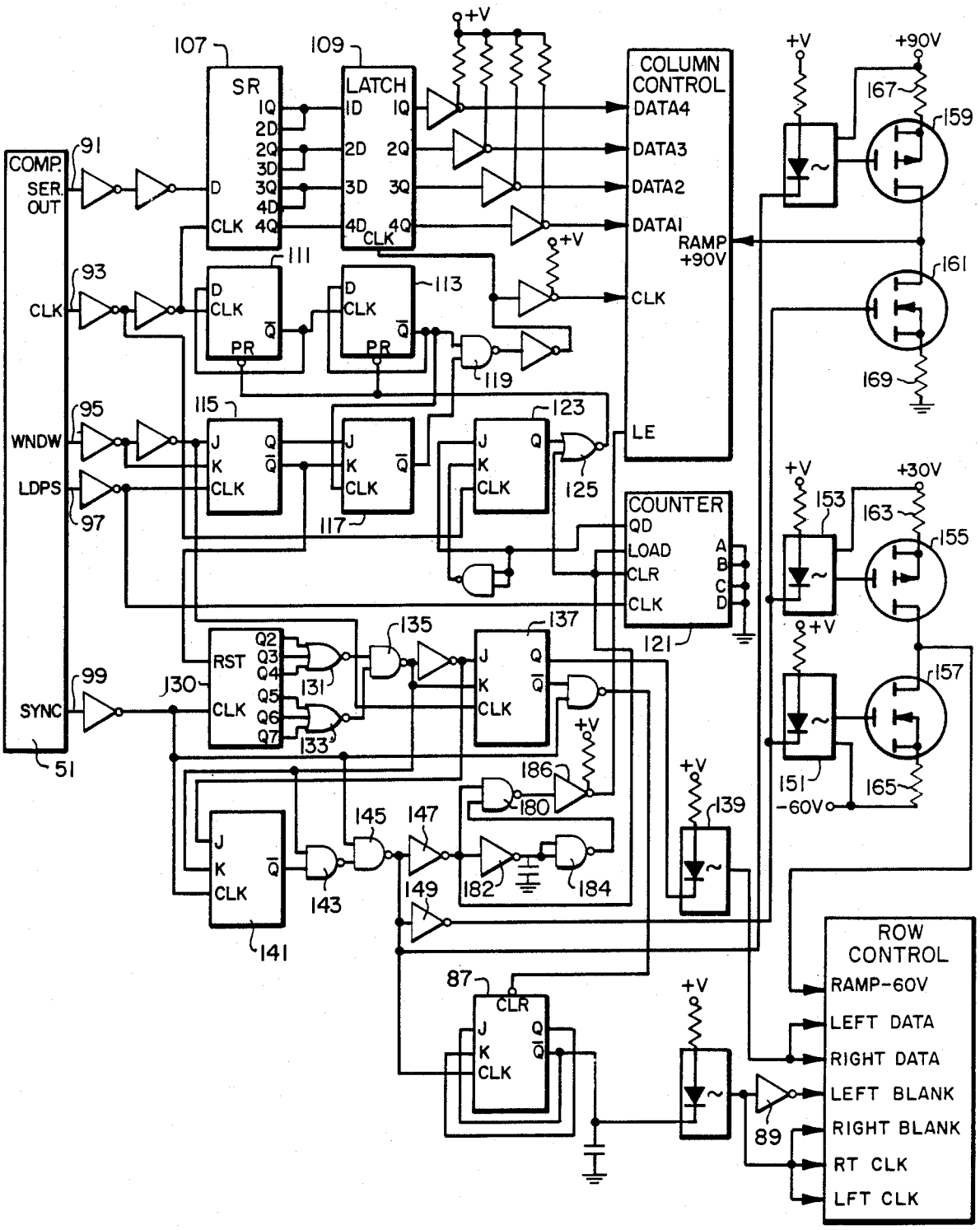
FIG. 10 is a logic circuit diagram of the drive circuit of FIG. 9.

FIG. 10 illustrates a logic circuit diagram of the system of FIG. 8. FIG. 11 illustrates a timing diagram of operational signals for the logic circuit of FIG. 10. As shown in FIG. 10, the Apple IIc computer 51 generates serial video data at its output 91, 14 MHz clock signals at its output 93 and timing signals WNDW, LDPS and SYNC at respective outputs 95, 97 and 99.

The LDPS signal is a negative load pulse which is generated each time that the digital bits (pixels) of a character are passed from the serial output 91 of the computer. Thus, if the computer is generating data in the 80-column display mode, each character has 7 pixels of data and an LDPS pulse is therefore generated for each 7 pixels. However, if the computer is generating data in the 40-column or graphic display mode, each character contains 14 pixels or bits of data. Accordingly, in the 40-column or graphic mode the LDPS load pulse is generated once for each 14 pixels transmitted at the serial output 91. Thus, it should be understood that the frequency of the LDPS load pulses generated by the computer 51 indicates the selected display mode. Relatively high frequency LDPS load pulses indicate operation in the 80-column display mode, while lower frequency pulses indicate operation in the 40-column or graphic display modes.

With reference to FIG. 11, the WNDW signal is comprised of horizontal blanking pulses 101 (examples 101*a–c* are illustrated) which each precede the transmission of a row of data, intervals 106 (examples 106*a–c* are illustrated) which each contain a row of data, and a vertical blanking interval 103 which is generated after the last row of a frame or screen of data. Thus, as shown in FIG. 11, the interval 106*b* on the left of the timing diagram precedes the vertical blanking interval 1O3 and therefore contains the last row of data for a frame or screen. On the other hand, the interval 106*c* on the right of the timing diagram follows the interval 103 and therefore contains the first row of data for a following frame or screen.

The LDPS load pulses are continuously generated during the WNDW signals. The first LDPS load pulse which occurs after the trailing edge of WNDW signals generally designates the beginning of a display portion of each row of data contained within the respective following intervals 106. The timing of this first LDPS pulse thus indicates a start point within an interval 106 for locating valid character data which must be displayed. Also, a horizontal composite sync pulse 102 of the computer is generated for each horizontal blanking pulse 101. Sixty-seven of the pulses 102 and four portions 100 of a vertical sync pulse are generated during the vertical blanking interval 103.

The WNDW and LDPS signals are employed to detect the beginning of valid data, that is, the beginning of each row of data for the EL display. The signals are also used to adjust the timing of the clock for the EL display in accordance with the operational display mode.

With reference to FIG. 10, a four-bit shift register 107 receives serial row data from the computer 51. The shift register 107 is clocked by the first four clock pulses of the 14 MHz clock at port 93 of the computer. After the four bits of data are received by the shift register 107, they are shifted in parallel to a four-bit latch 109 and are applied from this latch to the four shift registers 55, 57, 59 and 61 described with respect to FIG. 8.

Flip-flops 111 and 113 divide the 14 MHz clock of the computer by four. The resulting 3.5 MHz clock gates successive groups of four bits of serial data into the shift registers 55–61 of FIG. 8.

The 3.5 MHz clock must gate into the column shift registers of the display only the incoming serial character data which is to be displayed. Accordingly, a JK flip-flop 115 receives the WNDW signal at its data inputs and receives the LDPS pulses at its clock input. The flip-flop 115 generates a "Data Valid" signal to indicate the point in time at which valid serial character data is being generated for display at the port 91 of the computer 51. With reference to FIG. 11, the Valid Data indication is defined as true at the time of the first LDPS pulse following the trailing edge of WNDW. The Valid Data signal is generated at the output of the flip-flop 115 when LDPS clocks the flip-flop on the trailing edge of WNDW. The output is applied to an adjacent flip-flop 117 to synchronize the Data Valid signal with respect to the 3.5 MHz clock of the dividers 111 and 113. Thus, the output of the 3.5 MHz clock is applied to the clock input of the flip-flop 117 and the Data Valid signal of the flip-flop 115 is applied to the data inputs of the flip-flop 117. The flip-flop 117 generates a Data Valid signal which is synchronized to the 3.5 MHz clock.

The synchronized Data Valid signal of the flip-flop 117 is applied to enable a NAND gate 119 so that the gate passes the 3.5 MHz clock signals which occur when data is valid. These clock signals are then passed to gate the four bits of data from the shift register 107 to the latch 109 and to gate the data from the latch 109 into the shift registers 55, 57, 59 and 61 of FIG. 8. The Data Valid signal thus applies the 3.5 MHz clock signals to gate into the shift registers of the EL display only the character data which must be displayed.

In order to achieve proper gating of data, the phase of the 3.5 MHz clock must be adjusted, depending upon the data display mode. Also, in order to avoid the data loss associated with the mode switching problem of FIGS. 7A and 7B, the 3.5 MHz clock must be synchronized and the Data Valid condition must be checked for every row of data. Moreover, the 3.5 MHz clock must be synchronized with respect to the display mode prior to the detection of the Data Valid condition and the consequent gating of valid character data.

In the system of FIG. 10, a counter 121 detects the display mode of data during horizontal sync pulses HSYNCD of FIG. 9. The HSYNCD pulses correspond to horizontal sync pulses of the computer and are generated in a manner to be described hereafter. It is known that the pulses HSYNCD have a fixed pulse width of 56 pulses of the 14 MHz clock. Accordingly, if eight LDPS pulses are counted by the counter 121 within a HSYNCD pulse, the system is operating in the 80-column mode. Alternatively, if only four LDPS pulses are detected within the HSYNCD pulse, the system is operating in the 40-column or graphic display mode.

A circuit to be described in detail hereafter detects the horizontal sync pulses of the computer and generates corresponding derived pulses HSYNCD for the clear and load inputs of the counter 121. When the HSYNCD pulse is not present, the counter is maintained in a cleared state. However, when the HSYNCD pulse is present, LDPS pulses are applied to the clock input of the counter 121 and the counter then counts the number of pulses which occur during the HSYNCD pulse. If a count of eight is detected, the QD output of the counter 121 generates a high signal which is applied to a JK flip-flop 123 that is clocked by the 14 MHz clock. The JK flip-flop 123 thus provides a signal at its output that is delayed by one 14 MHz clock cycle from the trailing edge of the HSYNCD pulse. The output of the flip-flop 123 and the HSYNCD pulse itself are applied to a NOR gate 125 and the output of the NOR gate 125 is applied to preset inputs of the flip-flops 111 and 113 which generate the 3.5 MHz clock. Thus, the 3.5 MHz clock is synchronized with respect to the HSYNCD pulse and a one pixel adjustment in the phase of the 3.5 MHz clock is made if the system is operating in the 80-column display mode.

It should now be appreciated that, if the system is operating in either the 40-column or graphic display modes, the QD output of the counter 121 remains low and the HSYNCD pulse is applied to the preset inputs of the 3.5 MHz clock flip-flops to synchronize the clock signal so that four-bit data groups are clocked in the 40-column mode. Alternatively, if the system is operating in the 80-column mode, the counter 121 operates in association with the JK flip-flop 123 to preset the 3.5 MHz clock for an additional cycle of the 14 MHz clock and therefore shifts the phase of the 3.5 MHz clock by 90° to synchronize the clock with serial data arriving in the 80-column display mode.

The synchronized 3.5 MHz clock signal clocks the flip-flop 117 and thus synchronizes the Data Valid signal to the four-bit gating scheme of the system of FIG. 10. The synchronized Data Valid signal is then used to control the transmission of 3.5 MHz clock gating signals to the column shift registers of FIG. 8.

The detection of the Data Valid point for incoming data from the computer 51 and the adjustment of the synchronization of the 3.5 MHz clock are required to ensure that the EL display will fully display 40-column, 80-column and graphics data and will therefore avoid the display problem of FIGS. 7A and 7B.

In the graphics mode, delayed LDPS pusles are occasionally generated to provide color display synchronization. These delayed pulses do not interfere with the timing of the circuit of FIG. 10 because the HSYNCD pulse which synchronizes the 3.5 MHz clock is delayed by the same amount and therefore compensates for the momentary phase shift of LDPS.

If the Apple IIc computer was designed to operate with an EL display, the computer would generate the vertical synchronization and horizontal synchronization pulses VSYNCD and HSYNCD illustrated at FIG. 9. These pulses could then be applied directly to operate the above-described circuitry of FIGS. 8 and 10. However, the Apple IIc computer was originally designed to operate with CRT displays. This operation was facilitated by use of a SYNC signal which is comprised of the Exclusive Or of the vertical and horizontal sync pulses of the computer. In order to operate the EL display horizontal sync pulses must be extracted from the SYNC signal and an EL vertical sync pulse VSYNCD must be generated as illustrated in FIG. 9.

With reference to FIGS. 10 and 11, a counter 130 detects the vertical blanking signal 103 of the SYNC signal. The vertical blanking signal is differentiated by utilizing the Data Valid signal of the flip-flop 115 to reset the counter 130 and thereafter counting the number of SYNC pulses which occur before the next resetting of the counter. With reference to FIG. 11, it can be seen that the counter will be reset by the Data Valid signal of the data pulse **106*b* after only one SYNC pulse 102 is counted. However, following the resetting of the counter 130, a series of 71 SYNC pulses will be counted during the vertical blanking signal 103 before the counter is reset by the Data Valid signal of the data pulse 106*c* following the vertical blanking signal. Thus, in the presence of a vertical blanking signal, the counter 130 will count more than one SYNC pulse and will in fact count 71** SYNC pulses.

The NOR gates 131 and 133 apply the outputs of the counter 130 to force a high signal at the output of a NAND gate 135 which indicates that a vertical blanking signal has been detected. The output of the NAND gate 135 is applied to a JK flip-flop 137 which is in turn clocked by the trailing edge of the WNDW signal. The flip-flop 137 thus acts as a delay which will cause the derived vertical sync pulse VSYNCD to be generated at the Q output of the flip-flop immediately following the end of each vertical blanking interval 103. The derived vertical sync signal VSYNCD is applied by means of an optical coupler 139 to the data input of the left and right shift registers 68 and 71 of FIG. 8.

The signal of the NAND gate 135 is also applied to the data input of a JK flip-flop 141 which is clocked by the SYNC signal. The flip-flop 141 operates in conjunction with gates 143 and 145 to remove from SYNC the computer's four portions 100 of the composite vertical sync pulse and 65 of the 71 composite vertical and horizontal sync pulses of SYNC which occur during the vertical blanking interval 103. The remaining 194 pulses are derived horizontal synchronization pulses HSYNCD which are generated at the outputs of inverters 147 and 149.

As discussed above, the HSYNCD pulses are applied to the counter 121 to detect the operational mode of the display. The HSYNCD pulses are also applied to optical couplers 151 and 153 which respectively control associated high power row driver transistors 155 and 157. With reference to FIG. 9, the leading edge of the HSYNCD pulse occurs at a time when the transistor 157 has previously charged the row power drivers to a negative 60 volts. The leading edge of the HSYNCD pulse therefore turns on the transistor 155 and thus begins to ramp discharge the −60 volts to a reverse supply voltage of, for example, +30 volts. At the trailing edge of the HSYNCD pulse, the transistor 155 is turned off and the transistor 157 is turned on to again begin the ramp charging of row power from +30 volts to a −60 volts.

The HSYNCD pulse is also applied to control high power transistors 159 and 161 to ramp up and ramp down power for the column drivers. In operation, the leading edge of the HSYNCD pulse occurs at a time when the transistor 159 has charged up the column driver power to +90 volts. When the leading edge of HSYNCD occurs, the transistor 159 is turned off and the transistor 161 is turned on to begin ramping the 90 volt signal to ground. At the trailing edge of the HSYNCD signal, the transistor 161 is turned off and the transistor 159 is turned on to begin ramping up the column driver power from 0 volts to +90 volts.

It should be understood that the time delay required for ramping up and ramping down the power signals is determined by the resistors 163, 165, 167 and 169 of the respective transistors 155, 157, 159 and 161. These resistors operate in conjunction with EL panel capacitance to define RC time constants which provide the required delay for ramping power up and down.

As previously discussed for FIG. 8, the HSYNCD pulse is also divided by two by a divider S7 and is then applied to control clocking and blanking for the left and right row shift registers. Also as discussed for FIG. 8, the leading edge of each HSYNCD pulse is delayed (by gates 180, 182, 184 and 186) and is applied to enable the column latches to receive data.

It should now be appreciated that a driver circuit has been disclosed for operating a high luminescence and high contrast EL display in accordance with clock and timing signals derived from an Apple IIc computer. The derived signals have further been applied to adjust the timing of the system to display data in the 40-column, 80-column and graphics display modes on a row by row basis.

Although a particular preferred embodiment of the EL display driver circuit of the invention has been disclosed, it should be understood that other circuits and components may be used to achieve the objects of the invention, without departing from the spirit of the invention. Thus, the invention may be embodied in other specific forms without departing from its spirit or essential characteristics. The present embodiments are, therefore, to be considered in all respects as illustrative and not restrictive. The scope of the invention is indicated by the claims rather than by the foregoing description. All changes which come within the meaning and range of the equivalents of the claims are intended to be embraced therein.

I claim:

1. A D.C. electroluminescent display with enhanced contrast and brightness, comprising:

a plurality of conducting row and column electrodes disposed in an intersecting overlapping relation to form a matrix;

a plurality of phosphor pixel elements disposed between said row and column electrodes in conductive contact with said electrodes and adjacent to the points of intersection of said electrodes, each pixel having means for emitting light in response to a D.C, voltage which exceeds a defined threshold voltage;

means for sequentially scanning each one of said row electrodes with a first predefined energization row voltage and for applying a second predefined de-energization row voltage to the row electrodes which are not being scanned; and means for applying a selected pattern of first column energization and second column de-energization voltages to said column electrodes for the scan of each row electrode, at least the first row or the first column energization voltages being greater than said threshold voltage, the pixels adjacent to intersecting scanned row electrodes and energized column electrodes lighting in response to a total energization voltage which exceeds said threshold voltage and which is defined by said first row energization and first column energization voltages;

all other pixels being unlighted in response to total voltages which are defined less than said threshold voltage by row and column voltages that include at least one of said de-energization voltages.

2. The display of claim 1, wherein said de-energization row voltage has the same polarity as the column energization voltage.

3. The display of claim 1, wherein said column de-energization voltage has the same polarity as the row energization voltage.

4. A method for increasing the brightness and contrast of D.C. electroluminescent display wherein a plurality of conducting row and column electrodes are arranged in intersecting overlapping relation to form a matrix, a plurality of phosphor pixels are disposed at the points of intersection of the electrodes and row and column drivers selectively apply energizing D.C. voltage to electrodes to cause selected pixels to emit light, the method comprising the steps of:

defining a row energization voltage for row electrodes and a column energization voltage for column electrodes, at least one of these energization voltages being greater than a threshold voltage required to light pixels;

defining a row de-energization voltage for row electrodes which when combined with the column energization voltage at the intersection of row and column electrodes produces a total voltage that is less than the threshold voltage;

defining a column de-energization voltage for column electrodes which when combined with either the row energization voltage or the row de-energization voltage at the intersection of row and column electrodes produces a total voltage that is less than the threshold voltage;

applying the row energization voltage to at least one selected row electrode;

applying the row de-energization voltage to the remaining row electrodes;

applying the column energization voltage to at least one selected column electrode;

applying the column de-energization voltage to the remaining column electrodes; and having pixels lighted only where intersecting row and column electrodes provide row and column energization voltages which define a total voltage in excess of said threshold voltage.

5. The method of claim 4, wherein at least one of said steps of defining de-energization voltages includes the step of defining a nonzero de-energization voltage.

6. The method of claim 4, wherein the defined column energization voltage has a polarity that is not different than the polarity of the row de-energization voltage and the column de-energization voltage has a polarity that is not different than the polarity of the row energization voltage.

7. In a computer display system of a type which transmits successive frames of data, each frame having a plurality of rows of character data, and generates a window signal that includes a horizontal blanking interval for each row of transmitted character data and a vertical blanking interval for each frame of character data, a load signal for each character which is transmitted and a horizontal sync signal for each row of displayed character data, the improvement comprising:

an electroluminescent display panel, including a plurality of conducting row and column electrodes disposed in intersecting overlapping relation to form a matrix;

a plurality of phosphor pixel elements disposed at the points of intersection of said electrodes;

means for sequentially scanning each one of said row electrodes with a predefined D.C. row energization voltage and for simultaneously applying a predefined D.C. de-energization row voltage to the row electrode which are not scanned; and means for applying a selected pattern of D.C. column energization and D.C. column de-energization voltages to said column electrodes for the scan of each row electrode, at least the row or the column energization voltages being greater than a threshold voltage required to light a pixel, the pixels of the scanned row in the intersecting energized columns receiving a total energization voltage which exceeds said threshold voltage for lighting the pixels to form characters corresponding to a display portion of said character data, all other pixels having a total voltage less than said threshold voltage so that said other pixels are not lighted;

clock means for generating clock pulses;

means for detecting the beginning of each row of a display portion of said character data;

means for detecting the line format for displaying each row of character data;

means for timing said clock signals from the beginning of the display portion of each row of character data and adjusting the phase of said clock pulses in response to the detected line format for the row; and means responsive to said clock means for forming said pattern of column energization and de-energization voltages corresponding to the display portion of each row of character data and displaying the characters of each row in the detected line format for the row.

8. The system of claim 7, wherein said de-energization row voltage is a positive voltage which produces with a positive column energization voltage a total voltage less than said threshold voltage.

9. The system of claim 7, wherein said column de-energization voltage is a negative voltage which produces with a negative row energization voltage a total voltage less than said threshold voltage.

10. The system of claim 7, wherein said means for detecting the beginning of the display portion of a row of character data includes means for detecting the trailing edge of said window signal and for recognizing the beginning of the display portion upon detection of the next following load signal.

11. The system of claim 7, wherein said means for detecting the line format includes means for differentiating a line format having 80 columns from a line format having 40 columns.

12. The system of claim 7, wherein said means for detecting the line format includes means for counting the number of load signals which occur during a horizontal sync signal for a row of data and for determining the line format from said number on a row by row basis.

13. The system of claim 12, wherein a count of eight load pulses designates a line format having 80 columns.

14. The system of claim 12, wherein a count of less than eight load pulses designates the 40-column line format.

15. The system of claim 7, wherein said means for detecting the line format includes means for detecting the frequency of the load signals which occur during a horizontal sync signal and for determining the line format from said frequency.

16. The system of claim 15, including means for identifying an 80-column line format when the higher of two preselected frequencies is detected and for identifying a 40-column line format when the lower of said two preselected frequencies is detected.

17. The system of claim 7, wherein said means for timing includes means for timing said clock signals from the end of said horizontal sync signal if a 40-column line format is detected and for timing said clock signals from one pixel after the end of said horizontal sync signal if an 80-column line format is detected.

18. The system of claim 7, wherein said means for timing includes means for timing said clock signals from the beginning of the display portion of a row of character data if a 40-column line format is detected and for timing said clock signals from the beginning of the display portion of a row of character display data and additionally shifting the phase of the clock means by 90° if an 80-column line format is detected.

* * * * *